US007417226B2

(12) United States Patent
Bajic et al.

(10) Patent No.: US 7,417,226 B2
(45) Date of Patent: Aug. 26, 2008

(54) MASS SPECTROMETER

(75) Inventors: Steven Bajic, Cheshire (GB); Robert Harold Bateman, Cheshire (GB)

(73) Assignee: Micromass UK Limited, Manchester (GB)

( * ) Notice: Subject to any disclaimer, the term of this patent is extended or adjusted under 35 U.S.C. 154(b) by 39 days.

(21) Appl. No.: 10/893,427

(22) Filed: Jul. 16, 2004

(65) Prior Publication Data

US 2007/0114439 A1 May 24, 2007

Related U.S. Application Data

(60) Provisional application No. 60/488,385, filed on Jul. 21, 2003.

(51) Int. Cl.
*H01J 49/10* (2006.01)

(52) U.S. Cl. ..... 250/288; 250/281; 250/282; 250/283; 250/287; 250/294

(58) Field of Classification Search ..... 250/281, 250/282, 283, 287, 396 R, 294, 288
See application file for complete search history.

(56) References Cited

U.S. PATENT DOCUMENTS

| | | | | |
|---|---|---|---|---|
| 5,485,016 | A | 1/1996 | Irie et al. | |
| 5,668,370 | A * | 9/1997 | Yano et al. | 250/288 |
| 6,573,510 | B1 | 6/2003 | Vella | |
| 6,794,646 | B2 * | 9/2004 | Tong et al. | 250/288 |
| 6,888,132 | B1 * | 5/2005 | Sheehan et al. | 250/288 |
| 7,095,019 | B1 * | 8/2006 | Sheehan et al. | 250/288 |
| 2002/0074491 | A1 * | 6/2002 | Fukuda | 250/288 |
| 2002/0125423 | A1 * | 9/2002 | Ebeling et al. | 250/288 |
| 2003/0015657 | A1 | 1/2003 | Takada et al. | |
| 2003/0224529 | A1 * | 12/2003 | Maiefski et al. | 436/173 |

FOREIGN PATENT DOCUMENTS

| | | |
|---|---|---|
| CA | 928199 | 6/1971 |
| EP | 1 339 088 | 8/2003 |
| GB | 2 299 445 | 3/1996 |
| GB | 0410257.0 | 11/2004 |
| JP | 8236064 | 2/1995 |
| JP | 2001183343 | 12/1999 |
| WO | WO 02/071816 A3 | 9/2002 |

* cited by examiner

*Primary Examiner*—Jack I. Berman
*Assistant Examiner*—Michael Maskell
(74) *Attorney, Agent, or Firm*—Jamie H. Rose; Anthony J. Janiuk

(57) ABSTRACT

An Atmospheric Pressure Chemical Ionisation ("APCI") ion source is disclosed comprising a housing 14 having a corona discharge chamber 1, a reaction chamber 2 and a passage 6 connecting the corona discharge chamber 1 to the reaction chamber 2. Reagent ions are formed in the corona discharge chamber 1 and pass to the reaction chamber 2 via the passage 6. Analyte is sprayed into a heated tube 3. Low to moderately polar analyte molecules pass from the heated tube 3 into the reaction chamber 2 whereupon the analyte molecules are ionised by interacting with reagent ions. In contrast, highly polar analytes are ionised by thermal ionisation processes within the heated tube 3 and hence highly polar analyte ions pass into the reaction chamber 2. Analyte ions entering the reaction chamber 2 are substantially shielded from the effects of an electric field generated in the corona discharge chamber 1 as part of the process of generating reagent ions. The APCI ion source according to the preferred embodiment is able to optimally ionise a sample containing both low to moderately polar analytes and also highly polar analytes.

31 Claims, 6 Drawing Sheets

MASS SPECTROMETER

CROSS REFERENCE TO RELATED APPLICATIONS

This application claims benefit of United Kingdom application GB 0316628.7, filed 16 Jul. 2003 and U.S. application 60/488,385, filed 21 Jul. 2003. The contents of each of the aforementioned applications are hereby expressly incorporated herein by reference in their entirety.

STATEMENT ON FEDERALLY SPONSORED RESEARCH

N/A

FIELD OF INVENTION

The present invention relates to an ion source, a mass spectrometer, an Electrospray Ionisation/Atmospheric Pressure Chemical Ionisation ("ESI/APCI") ion source and a method of producing ions. The preferred embodiment relates to an Atmospheric Pressure Chemical Ionization ("APCI") ion source.

BACKGROUND OF INVENTION

Chemical ionization involves the transfer of charged species from reagent ions to analyte molecules to produce analyte ions that can be subsequently mass analysed. The charged species most commonly formed in positive ion mode is the adduct between the analyte molecule and positive hydrogen ions ($H^+$).

Chemical ionization conducted at atmospheric pressure is known as Atmospheric Pressure Chemical Ionization ("APCI"). A sample containing analyte material is typically delivered to an Atmospheric Pressure Chemical Ionization ion source as a solution. The solution containing the analyte is then sprayed into a heated tube through which a nebulising gas is also directed. The nebulising gas causes the sprayed solution to be nebulised into fine droplets which then impact the inner wall of the heated tube and are converted into the gas phase. As the solution is converted into the gas phase the analyte molecules become desolvated. Hot gas comprising mobile phase solvents, microdroplets and desolvated analyte molecules then exit the heated tube and expand towards a corona needle. The analyte molecules are then ionised by chemical ionization with reagent ions produced by a corona discharge in the presence of a reagent gas. In particular, analyte molecules are ionised by gas phase ion-molecule reactions between reagent ions and analyte molecules.

In this conventional arrangement, analytes that exit the heated tube in the form of neutral gaseous molecules, ions or charged micro-droplets directly pass the corona needle prior to entering the vacuum section of a mass spectrometer via an ion sampling orifice. Only a relatively small proportion of the analyte ions formed at atmospheric pressure are actually drawn through a small aperture into the vacuum system of the mass spectrometer for subsequent mass analysis Reagent ions which transfer charged species to the analyte molecules to form analyte ions are produced as a result of a corona discharge in solvent vapour. The corona discharge is generated by applying a high voltage (e.g. 5 kV) to the tip of a sharp corona needle or pin.

Analyte molecules are ionised by gas phase ion-molecule reactions with reagent ions in the region between the corona tip and the ion sampling orifice. Analyte ions are therefore generated in the region of the corona discharge since this is also where the reagent ions are formed.

The majority of the gas exits the ion source via an exhaust port whilst a small proportion of the gas and analyte ions will be drawn through the ion sampling orifice into the vacuum system of the mass spectrometer for subsequent mass analysis.

Analyte samples which are low to moderately polar when analysed by Atmospheric Pressure Chemical Ionisation typically exhibit an increase in ion signal intensity as the voltage or current applied to the corona needle is increased. In contrast, highly polar or ionic analytes typically exhibit a decrease in ion signal intensity as the voltage or current applied to the corona needle is increased. Therefore, in order to achieve a sufficiently high ion signal intensity for highly polar or ionic analytes these analytes are conventionally generated using an ion source other than an Atmospheric Pressure Chemical Ionisation ion source, such as, for example, an Electrospray Ionisation ("ESI") ion source.

It is believed that in Atmospheric Pressure Chemical Ionisation ion sources highly polar or ionic analytes emerge from the outlet of the heated tube in the form of ions or charged micro-droplets before the analytes have had an opportunity to interact with reagent ions. As the corona needle is maintained at a relatively high positive potential (for positive ion analysis) an electric field is generated in the region of the corona needle. The electric field generated by the corona needle will tend to retard and disperse the already positively charged analyte ions or micro-droplets which exit the heated tube causing the analyte ions or charged analyte micro-droplets to become defocussed in the region of the ion sampling orifice. Accordingly, if the voltage or current applied to the corona needle is further increased then the positive analyte ions or micro-droplets will simply be retarded and dispersed to an even greater extent and hence even fewer analyte ions will pass through the ion sampling orifice into the main body of the mass spectrometer for subsequent mass analysis and detection. Accordingly, the ion signal intensity for highly polar or ionic analytes is significantly decreased as the corona current is increased.

It follows that the ion signal intensity for highly polar or ionic analytes is optimized when a relatively low current or voltage is applied to the corona needle. In contrast, the ion signal intensity for low to moderately polar analytes is optimized when a relatively high current or voltage is applied to the corona needle. This is because when a higher current or voltage is applied to the corona needle a higher number of reagent ions are generated in the region of the corona needle. The increased number of reagent ions interact with the analyte molecules and generate a higher number of analyte ions. As low to moderately polar analytes do not generally become charged before they exit the heated tube and approach the corona needle, the low to moderately polar analyte molecules are not retarded and dispersed by the electric field generated by the corona needle. Accordingly, as the current or voltage applied to the corona needle is increased a higher number of analyte ions are generated (due to the increased number of reagent ions produced) and these analyte ions pass through the ion sampling orifice for subsequent mass analysis and hence a greater ion signal intensity is detected.

It will be appreciated, therefore, that in order to analyse samples containing a mixture of both low to moderately polar analytes and also highly polar or ionic analytes using a conventional Atmospheric Pressure Chemical Ionisation ion source, that it is necessary to execute multiple sequential experimental runs in which different voltages or currents are applied to the corona needle of the ion source (e.g. a relatively low corona current is set in a first experimental run so that ionisation is optimised for highly polar analytes and a relatively high corona current is set in a second experimental run so that ionisation is optimised for low to moderately polar analytes). Executing multiple experimental runs whilst applying different voltages or currents to the corona needle yields multiple sets of data which together provide a relatively high ion signal intensity for each analyte in the sample irrespective of the polarities or ionic nature of the analytes in the sample. However, the requirement to repeat the data acquisition process whilst applying different voltages or currents to the corona needle increases both the sample analysis time and the sample consumption volume. This can be a particular problem especially when only very small amounts of sample are available for analysis and also when the sample supplied to the ion source is dynamically changing in a short period of time, for example in chromatography applications.

It is therefore desired to provide an improved ion source.

SUMMARY OF INVENTION

According to an aspect of the present invention there is provided an ion source for a mass spectrometer comprising:

a discharge region with a discharge device arranged in the discharge region; and a reaction region;

wherein in use reagent ions created in the discharge region pass from the discharge region into the reaction region and analyte molecules and/or analyte ions pass into the reaction region, wherein ions in the reaction region are at least partially shielded from an electric field generated by the discharge device in the discharge region.

The discharge region preferably comprises a discharge chamber and the discharge device preferably comprises a corona discharge device such as a corona needle or pin. In a mode of operation a current of<0.1 μA, 0.1-0.2 μA, 0.2-0.3 μA, 0.3-0.4 μA, 0.4-0.5 μA, 0.5-0.6 μA, 0.6-0.7 μA, 0.7-0.8 μA, 0.8-0.9 μA, 0.9-1.0 μA or >1 μA may be applied to the discharge device. In a mode of operation a voltage of <1 kV, 1-2 kV, 2-3 kV, 3-4 kV, 4-5 kV, 5-6 kV, 6-7 kV, 7-8 kV, 8-9 kV, 9-10 kV or >10 kV may be applied to the discharge device.

According to the preferred embodiment the reaction region comprises a substantially field free region. Preferably, the reaction region comprises a reaction chamber. A passage or orifice preferably connects or communicates the discharge region to or with the reaction region, wherein in use reagent ions created in the discharge region pass from the discharge region to the reaction region via the passage or orifice. A housing preferably encloses the discharge region, the reaction region and the passage or orifice.

According to the preferred embodiment the corona discharge from the corona discharge device is confined to the discharge region or the corona discharge chamber. Accordingly, no discharge occurs within the reaction region or reaction chamber. As a result analyte molecules or analyte ions in the reaction region or reaction chamber are not exposed to a corona discharge.

A gas inlet is preferably arranged upstream of the discharge region, the gas inlet receiving, in use, a reagent gas which is supplied to the discharge region. A gas outlet is preferably arranged downstream of the reaction region, the gas outlet discharging, in use, gas and/or analyte ions and/or reagent ions.

The ion source preferably comprises an Atmospheric Pressure Ionisation ion source, further preferably an Atmospheric Pressure Chemical Ionisation source.

The discharge region and/or the reaction region are preferably maintained, in use, at a pressure selected from the group consisting of: (i) <100 mbar; (ii) 100-500 mbar; (iii) 500-600 mbar; (iv) 600-700 mbar; (v) 700-800 mbar; (vi) 800-900 mbar; (vii) 900-1000 mbar; (viii) 1000-1100 mbar; (ix) 1100-1200 mbar; (x) 1200-1300 mbar; (xi) 1300-1400 mbar; (xii) 1400-1500 mbar; (xiii) 1500-2000 mbar; and (xiv) >2000 mbar.

The ion source preferably comprises a spray device for spraying a sample and for causing the sample to form droplets. A nebulising gas is preferably supplied to further nebulise the droplets formed by the spray device. A heated tube is preferably provided upon which, in use, at least some of the droplets formed by the spray device impinge. The heated tube preferably discharges or supplies, in use, analyte molecules and/or analyte ions into the reaction region.

The ion source may preferably comprise a pneumatic nebuliser or a pneumatically assisted electrospray nebuliser.

According to another aspect of the present invention there is provided a mass spectrometer comprising an ion source as described above.

The mass spectrometer preferably further comprises an ion sampling orifice. At least one electrode may be arranged opposite or adjacent to the ion sampling orifice so as to deflect, attract, direct or repel at least some ions towards the ion sampling orifice.

The ion source may be connected, in use, to a gas or liquid chromatograph.

The mass spectrometer preferably further comprises a mass analyser such as a Time of Flight mass analyser, a quadrupole mass analyser, a Penning mass analyser, a Fourier Transform Ion Cyclotron Resonance ("FTICR") mass analyser, a 2D or linear quadrupole ion trap, a Paul or 3D quadrupole ion trap or a magnetic sector mass analyser.

According to another aspect of the present invention there is provided an Electrospray Ionisation/Atmospheric Pressure Chemical Ionisation ("ESI/APCI") ion source comprising:

a corona discharge device arranged in a corona discharge chamber;

wherein, in use, analyte molecules having a relatively low polarity are ionised by gas phase ion-molecule reactions with reagent ions; and wherein, in use, analyte molecules having a relatively high polarity are ionised by electrospray ionisation to form analyte ions, at least x % of the analyte ions being arranged to bypass, in use, the corona discharge chamber.

Preferably, x is selected from the group consisting of: (i) <1; (ii) 5; (iii) 10; (iv) 15; (v) 20; (vi) 25; (vii) 30; (viii) 35; (ix) 40; (x) 45; (xi) 50; (xii) 55; (xiii) 60; (xiv) 65; (xv) 70; (xvi) 75; (xvii) 80; (xviii) 85; (xix) 90; and (xx) 95.

The analyte ions which bypass, in use, the corona discharge chamber preferably at least partially avoid the effect of an electric field generated by the corona discharge device in the corona discharge chamber.

According to another aspect of the present invention there is provided an ion source comprising:

a reaction chamber for receiving analyte molecules and/or analyte ions; and a corona discharge chamber;

wherein, in use, reagent ions formed in the corona discharge chamber exit the corona discharge chamber and enter the reaction chamber and wherein analyte molecules and/or analyte ions do not substantially enter the corona discharge chamber.

According to another aspect of the present invention there is provided a method of producing ions comprising:

providing a discharge region with a discharge device arranged in the discharge region, and a reaction region;

creating reagent ions in the discharge region and passing the reagent ions from the discharge region into the reaction region; and passing analyte molecules and/or analyte ions into the reaction region, wherein ions in the reaction region are at least partially shielded from an electric field generated by the discharge device in the discharge region.

According to another aspect of the present invention there is provided a method of producing ions using an Electrospray Ionisation/Atmospheric Pressure Chemical Ionisation ("ESI/APCI") ion source comprising:

providing a corona discharge device arranged in a corona discharge chamber;

ionising analyte molecules having a relatively low polarity by gas phase ion-molecule reactions with reagent ions; and ionising analyte molecules having a relatively high polarity by electrospray ionisation to form analyte ions, at least x % of the analyte ions being arranged to bypass the corona discharge chamber.

Preferably, x is selected from the group consisting of: (i) <1; (ii) 5; (iii) 10; (iv) 15; (v) 20; (vi) 25; (vii) 30; (viii) 35; (ix) 40; (x) 45; (xi) 50; (xii) 55; (xiii) 60; (xiv) 65; (xv) 70; (xvi) 75; (xvii) 80; (xviii) 85; (xix) 90; and (xx) 95.

According to another aspect of the present invention there is provided a method of producing ions comprising:

providing a reaction chamber for receiving analyte molecules and/or analyte ions, and a corona discharge chamber; and causing reagent ions formed in the corona discharge chamber to exit the corona discharge chamber and enter the reaction chamber, wherein analyte molecules and/or analyte ions do not substantially enter the corona discharge chamber.

The preferred embodiment relates to an Atmospheric Pressure Chemical Ionization ion source wherein reagent ions are formed in an ancillary or discharge chamber separate from the region or reaction chamber through which the sample to be analysed flows. The reagent ions are carried by gas flow from the ancillary or discharge chamber to the reaction chamber whereupon the reagent ions can then interact with the desolvated analyte molecules and ionise the analyte molecules by chemical ionization. However, highly polar analytes which are already ionised by the time that they enter the reaction chamber are at least partially shielded from the effects of the electric field generated in the ancillary or discharge chamber. Accordingly, the corona current can be set high without affecting the signal intensity when highly polar analytes are ionised by the ion source.

Various embodiments of the present invention will now be described, by way of example only, and with reference to the accompanying drawings in which.

Figure 5:
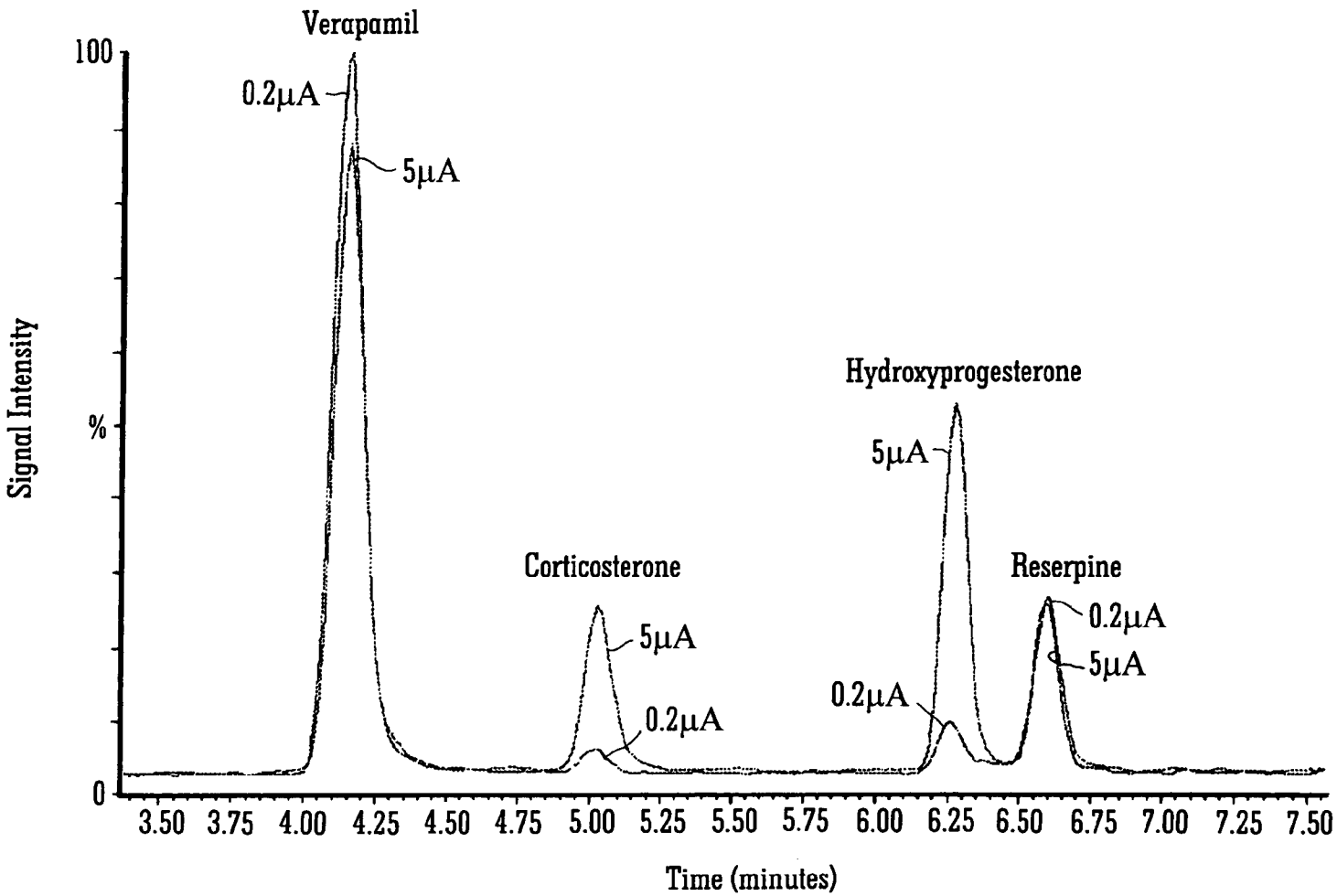
Figure 6:
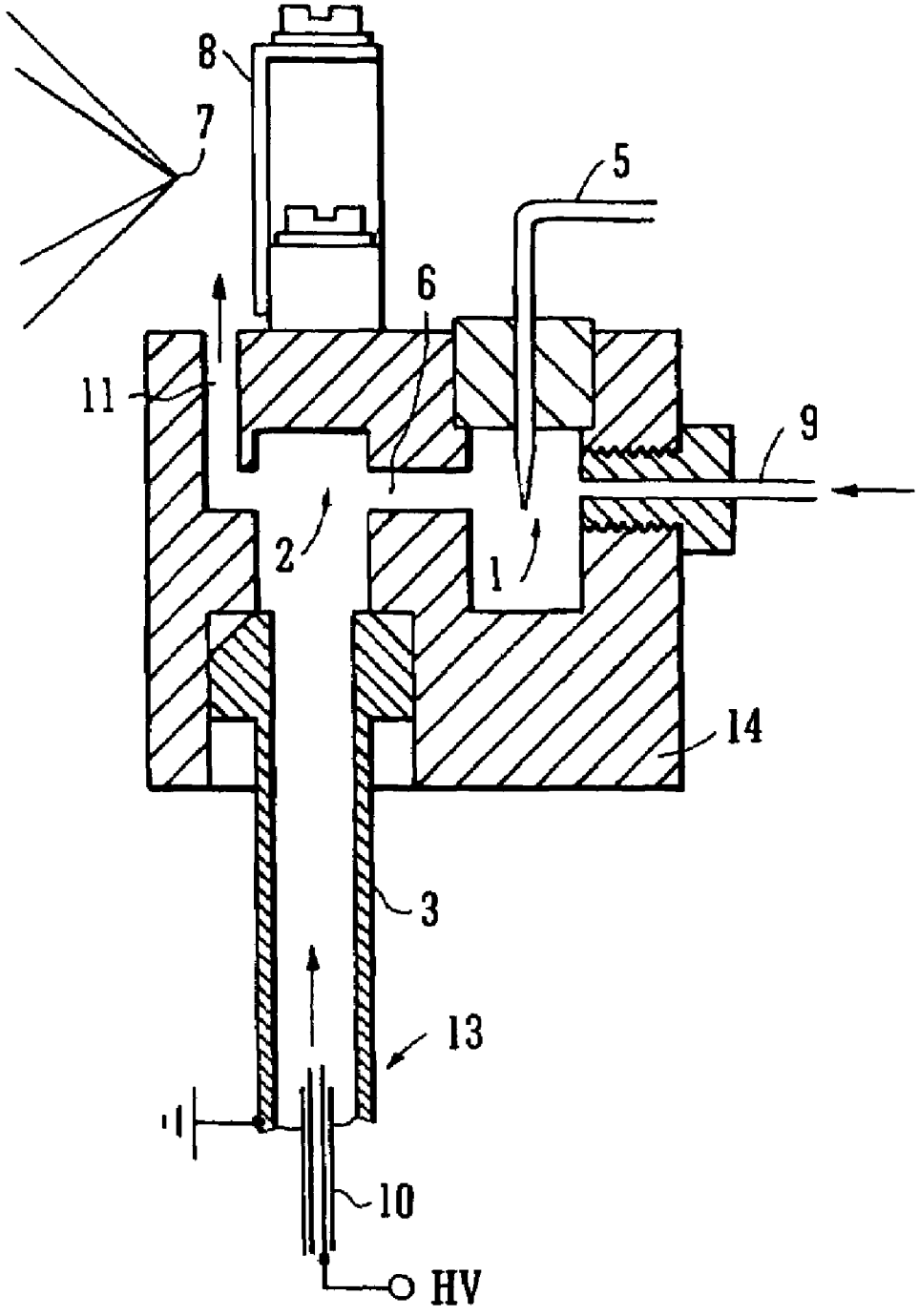

FIG. 5 shows two superimposed ion signal intensities obtained from two separate LC/MS MRM analyses of a sample comprising four different analytes wherein during the first acquisition the corona current was maintained at 0.2 μA (i.e. relatively low) and wherein during the second acquisition the corona current was maintained at 5 μA (i.e. relatively high); and FIG. 6 shows a dual chamber APCI ion source according to a second embodiment of the present invention wherein an electrospray nebuliser is used.

Figure 1:
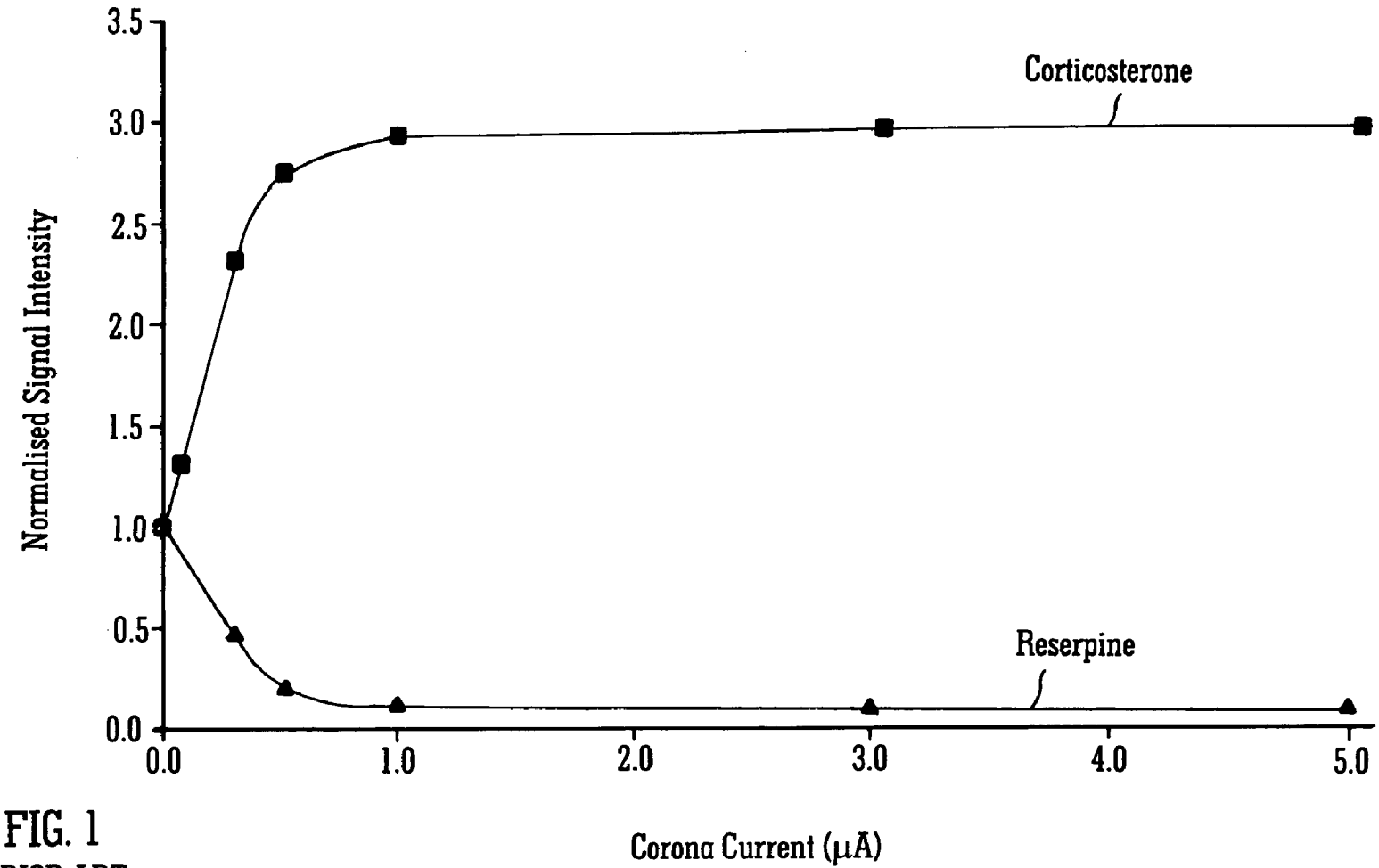
FIG. 1 PRIOR ART
FIG. 1 illustrates how the ion signal intensity for a highly polar sample (Reserpine) and a low to moderately polar sample (Corticosterone) vary as a function of the current applied to a corona needle of a conventional APCI ion source.

Referring to FIG. 1, this figure shows how the ion signal intensity varies as a function of the current applied to a corona needle of a conventional Atmospheric Pressure Chemical Ionisation ("APCI") ion source for two different types of analytes. As can be seen from FIG. 1, the ion signal intensity for a low to moderately polar sample (e.g. Corticosterone) increases relatively rapidly and then plateaus at a certain point as the current applied to the corona needle is further increased. The initial increase in ion signal intensity is believed to be due to the ion source producing more reagent ions as the current applied to the corona needle is increased. The increased number of reagent ions interact with the analyte molecules emitted from the nebuliser tube and hence more analyte ions are produced. Accordingly, an increased number of analyte ions are then subsequently mass analysed and hence an increase in the ion signal intensity is observed.

It can also be seen from FIG. 1 that increasing the current applied to the corona needle of the ion source has the opposite affect for a highly polar sample (e.g. Reserpine). As the current applied to the corona needle is increased, the ion signal intensity for Reserpine decreases relatively rapidly and then remains at a substantially constant low level. In contrast to low to moderately polar samples it is believed that relatively highly polar analytes such as Reserpine exit the nebuliser tube in an already charged state most likely due to thermal ionisation effects. The already charged analyte ions are therefore then effectively retarded by the electric field resulting from the voltage applied to the corona needle. The highly polar analyte ions are therefore deflected and dispersed by the electric field generated by the corona needle. Increasing the potential of the corona needle (which may as a consequence increase the current drawn from the corona needle) merely increases the strength of the electric field in the region of the corona needle and hence in the region adjacent to the exit of the nebuliser tube. Therefore, increasing the current applied to the corona needle merely increases the level of retardation, deflection and dispersal of the charged analyte ions which exit the nebuliser tube. As a result, as the corona current is increased, fewer analyte ions will ultimately pass through the ion sampling orifice and into the main body of the mass spectrometer for subsequent mass analysis.

In view of the different responses of low to moderately polar analytes and highly polar analytes to the current applied to the corona needle as shown in FIG. 1, the conventional approach when seeking to ionise a mixture containing both low to moderately polar analytes and also highly polar or ionic analytes is either to set the current applied to the corona needle at some compromise level (e.g. 0.25 μA for the example shown in FIG. 1) which results in sub-optimal ionisation for both types of analytes, or alternatively to perform two separate acquisitions in which a first acquisition is performed at a first corona current setting followed by a second acquisition performed at a second different corona current setting. The conventional approaches therefore either result in ion signals which are not maximised (if a single acquisition at a compromise corona current is performed) or alternatively the total analysis time and sample consumption is effectively doubled (if two separate acquisitions at two different corona currents are performed).

Figure 2:
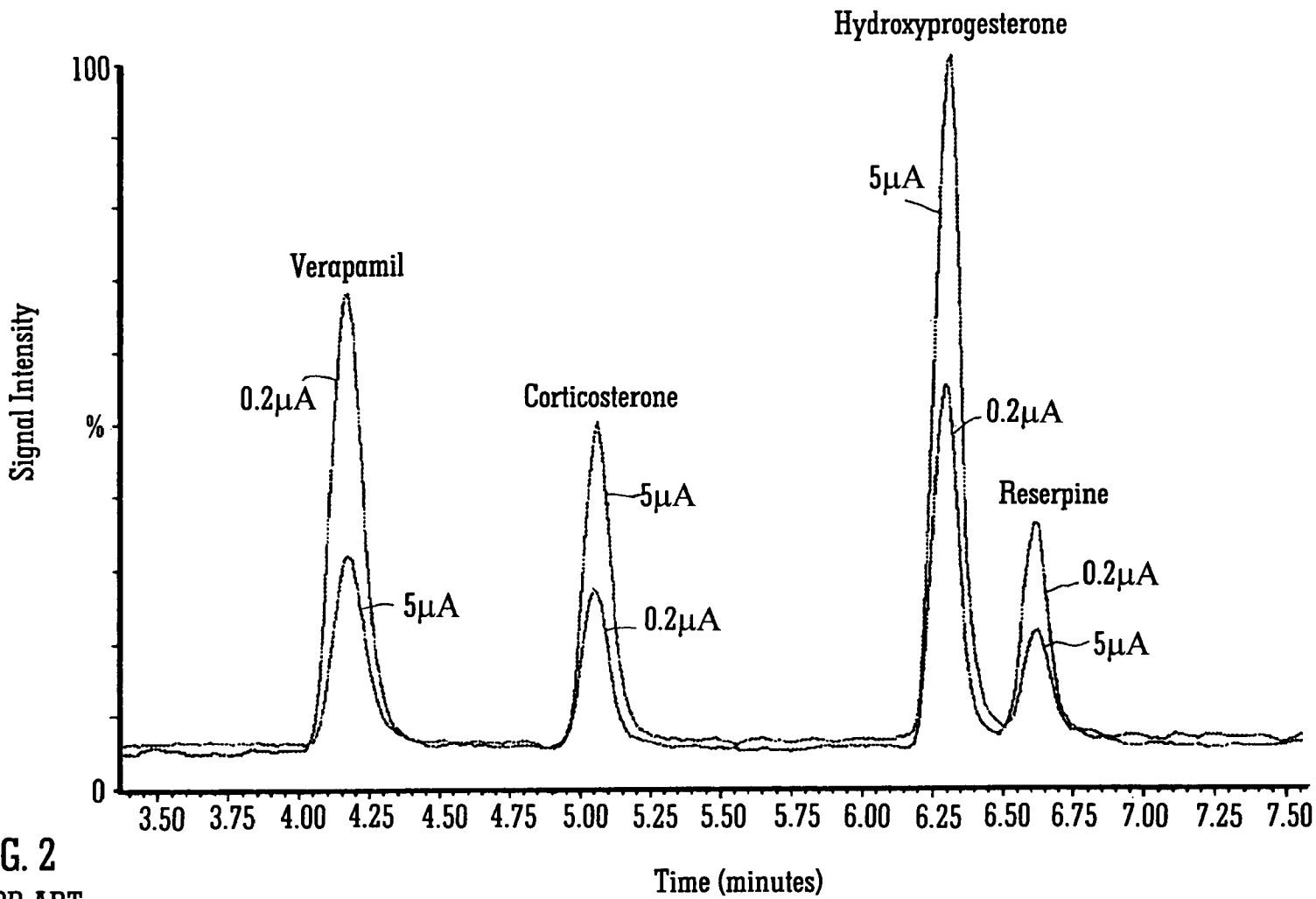
FIG. 2 PRIOR ART
FIG. 2 shows two superimposed ion signal intensities obtained from two separate LC/MS MRM analyses of a sample comprising four different analytes wherein during the first acquisition the corona current was maintained at 0.2 μA (i.e. relatively low) and wherein during the second acquisition the corona current was maintained at 5 μA (i.e. relatively high)

FIG. 2 shows the results of a four channel Multiple Reaction Monitoring ("MRM") experiment performed using a conventional APCI ion source in conjunction with a triple quadrupole mass spectrometer. In particular FIG. 2 shows an overlay of the ion signals resulting from two separate acquisitions in which a mixture comprising Verapamil, Corticosterone, Hydroxyprogesterone and Reserpine was analysed using Liquid Chromatography Mass Spectrometry ("LCMS").

As will be understood by those skilled in the art, in a MRM experiment a first mass filter (e.g. quadrupole rod set mass filter) is set to transmit parent ions having a certain (specific) mass to charge ratio. The selected parent ions having a particular mass to charge ratio are then introduced into a collision or fragmentation cell wherein the parent ions are fragmented into daughter or fragment ions. A second mass filter (e.g. quadrupole rod set mass filter) provided downstream of the collision or fragmentation cell is then arranged to transmit daughter or fragment ions having a certain (specific) mass to charge ratio.

In this and the subsequent described MRM experiment, Verapamil parent ions having a mass to charge ratio of 455.1 were transmitted by the first mass filter and were fragmented in a collision or fragmentation cell. Characteristic daughter or fragment ions having a mass to charge ratio of 165.1 were arranged to be transmitted by the second mass filter. Corticosterone parent ions having a mass to charge ratio of 347.1 were transmitted by the first mass filter and were fragmented in the collision or fragmentation cell. Characteristic daughter or fragment ions having a mass to charge ratio of 329.1 were arranged to be transmitted by the second mass filter. Hydroxyprogesterone parent ions having a mass to charge ratio of 331.1 were transmitted by the first mass filter and were fragmented in the collision or fragmentation cell. Characteristic daughter or fragment ions having a mass to charge ratio of 109.1 were arranged to be transmitted by the second mass filter. Finally, Reserpine parent ions having a mass to charge ratio of 609.1 were transmitted by the first mass filter and were fragmented in the collision or fragmentation cell. Characteristic daughter or fragment ions having a mass to charge ratio of 195.1 were arranged to be transmitted by the second mass filter.

A first experimental run or acquisition was performed over a period of 20 minutes (including column equilibrium) during which time the four analytes eluted within a time of 7 minutes and wherein a current of 0.2 μA was applied to the corona needle. A second experimental run or acquisition was then subsequently performed over another period of 20 minutes (including column equilibrium), again wherein the four analytes eluted within a time of 7 minutes but wherein a current of 5 μA was applied to the corona needle. The analytes in order of elution were Verapamil, Corticosterone, Hydroxyprogesterone followed lastly by Reserpine. Verapamil and Reserpine are highly polar analytes/molecules whereas Corticosterone and Hydroxyprogesterone are moderately polar analytes/molecules.

It can be seen from FIG. 2 that the difference in the resulting ion signal intensities detected for the two separate experimental runs or acquisitions is relatively large, especially for the relatively highly polar analyte Verapamil. As can also be seen from FIG. 2, as the current applied to the corona needle was increased in the second experimental run or acquisition from 0.2 μA to 5 μA, the ion signal intensity for the relatively highly polar analytes Verapamil and Reserpine significantly decreased whereas the ion signal intensity for the low to moderately polar analytes Corticosterone and Hydroxyprogesterone increased.

In this conventional technique utilising two separate experimental runs in which different currents are applied to the corona needle a sufficiently high ion signal intensity is obtainable for each of the two different types (i.e. polarities) of analytes in the sample during one or other of the experimental runs. However, as the analysis is effectively repeated whilst applying the different currents to the corona needle, the time required to analyse a sample using such a conventional technique is relatively long. For example, the total analysis time for each chromatogram can be 20 minutes including column equilibration. Furthermore, repeating the experimental run whilst applying a different current to the corona needle increases the sample consumption volume.

Figure 3:
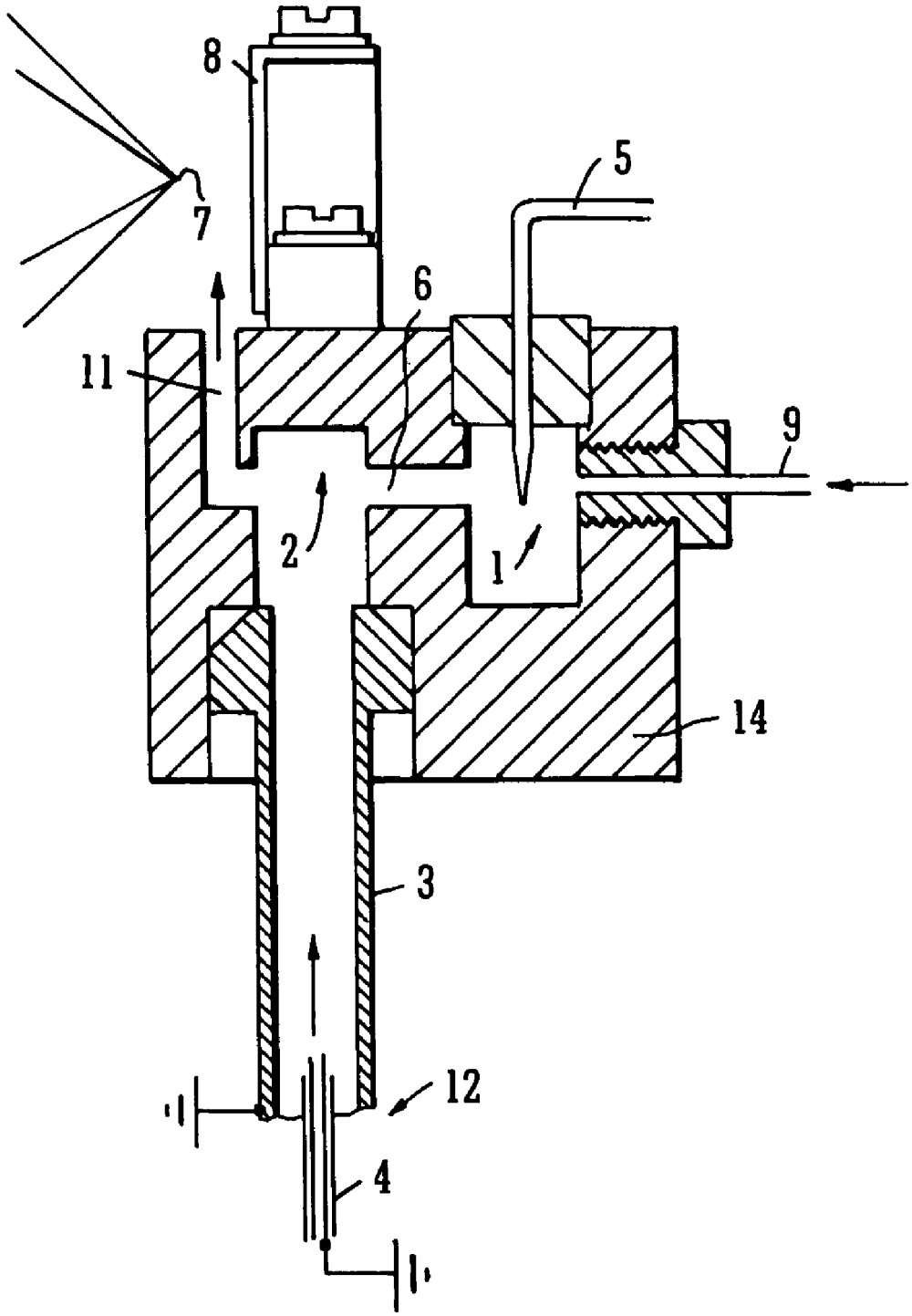
FIG. 3 shows a dual chamber APCI ion source according to a first embodiment of the present invention wherein a pneumatic nebuliser is used.

FIG. 3 shows an Atmospheric Pressure Ionisation ion source according to a first embodiment of the present invention. The ion source comprises a corona discharge chamber 1 which houses the tip of a corona needle 5. A reaction chamber 2 is provided downstream of the corona discharge chamber 1 and is in communication with the corona discharge chamber 1 via a passage or orifice 6. The reaction chamber 2 is preferably arranged adjacent to the corona chamber 1 within a housing 14. The reaction chamber 2 is also preferably in communication with a source of a sample to be analysed. The ion source preferably comprises a nebuliser probe 12. The nebuliser probe 12 preferably comprises a pneumatic nebuliser 4 and a heated tube 3 for heating a liquid sample sprayed from the nebuliser 4 to convert the sample into a gaseous state for subsequent ionisation and mass analysis. The reaction chamber 2 is preferably arranged in the region of the exit of the heated tube 3 of the nebuliser probe 12.

During operation of the preferred ion source a sample is preferably delivered to the ion source by, for example, a chromatography system. The sample is preferably delivered to the pneumatic nebuliser 4 of the nebuliser probe 12 in a liquid state and is then sprayed from the nebuliser 4 and nebulised by a relatively high velocity stream of gas, preferably nitrogen gas. The sample droplets which result from the nebulisation comprise mobile phase solvents and analytes. These preferably enter and pass through the heated tube 3. The nebulised droplets of sample solution are preferably heated in the heated tube 3 such that the sample is converted from a liquid state into the gaseous phase. After the sample has been converted into the gaseous phase it preferably passes into the reaction chamber 2.

Reagent ions are generated in the ion source in a discharge region 1 which preferably comprises the corona chamber 1 housing the corona needle or pin 5. In order to generate the reagent ions a reagent gas such as, for example, nitrogen and a solvent such as, for example, methanol are arranged to flow into the corona chamber 1 via a gas inlet 9. The voltage applied to the corona needle 5 (e.g. ~3 kV) preferably generates a corona discharge in the corona chamber 1 which serves to ionise molecules in the reagent gas. As a result, a population of stable reagent ions are formed within the vicinity of the tip of the corona needle 5. The polarity of the voltage applied to the corona needle 5 is preferably positive for positive ion analysis and is preferably negative for negative ion analysis. The reagent ions generated in the corona chamber 1 are then preferably transmitted from the corona chamber 1 to the reaction chamber 2 through the passage or orifice 6 which links the two chambers 1, 2 preferably by the flow of reagent gas through the corona chamber 1.

The reagent ions passing from the corona chamber 1 into the reaction chamber 2 preferably mix and interact with the gaseous sample exiting from the heated tube 3. The reagent ions preferably undergo gas phase ion-molecule interactions with any analyte molecules in the gaseous sample within the reaction chamber 2. These ion-molecule interactions result in at least some of the reagent ions transferring a charged species to the analyte molecules such that the analyte molecules preferably become ionised and the reagent ions preferably become neutralised.

In the preferred embodiment, any low to moderately polar analytes present in the sample to be analysed pass through the heated tube 3 and into the reaction chamber 2 predominantly as neutral analyte molecules. In contrast, relatively highly polar or ionic analytes which may be present in the sample preferably exit the heated tube 3 and enter the reaction chamber 2 already as ions i.e. the highly polar or ionic analytes are already ionised (most likely by thermal ionization) prior to encountering reagent ions in the reaction chamber 2.

Any neutral analyte molecules which exit the heated tube 3 and which enter the reaction chamber 2 preferably undergo interactions with the reagent ions and become ionised such that at least some, preferably substantially all of the analytes in the sample are ionised. The resulting analyte ions, other particles and gas in the reaction chamber 2 then preferably exits the reaction chamber 2 via an outlet passage or port 11 preferably under the influence of both the flow of gas exiting the heated tube 3 and also the flow of gas through the corona chamber 1 which also passes into the reaction chamber 2.

In a preferred embodiment the gas and ions which exit the reaction chamber 2 via the passage or orifice 11 flow into a region adjacent an ion sampling cone having an ion sampling orifice 7. The ion sampling orifice 7 is preferably arranged off-axis with respect to the axis of the passage or orifice 11 such that the gas and ions exiting the passage or orifice 11 preferably do not flow directly through the ion sampling orifice 7. At least one electrode is preferably arranged in the region of the ion sampling orifice 7 in order to provide an electric field which deflects (or less preferably attracts) at least some of the analyte ions through the ion sampling orifice 7 and into the main body of the mass spectrometer. A pusher electrode 8 may, for example, be arranged substantially opposite to the ion sampling orifice 7 such that the gas and ions exiting the passage or orifice 11 flows between the pusher electrode 8 and the ion sampling orifice 7. In the preferred embodiment, the pusher electrode 8 causes at least some of the ions exiting the passage or orifice 11 to be deflected into and through the ion sampling orifice 7. Preferably, the pusher electrode 8 deflects at least some of the ions exiting the passage or orifice 11 substantially at right angles to the axis of the passage or orifice 11. The arrangement of the ion sampling orifice 7 and the provision of the pusher electrode 8 therefore enables at least some ions to be directed into and through the ion sampling orifice 7 for subsequent mass analysis whilst not assisting neutral molecules and gas to pass through the ion sampling orifice 7. In a preferred embodiment, the voltage applied to the pusher electrode 8 is in the range of 0-300 V.

In a less preferred embodiment the pusher electrode 8 may be omitted and the ion sampling orifice 7 and the passage or orifice 11 may be arranged such that the axis of the passage or orifice 11 is substantially coaxial with the axis of the ion sampling orifice 7. In this embodiment at least one additional electrode (not shown) may be provided to focus or direct at least some of the ions into and through the ion sampling orifice 7.

Gas passing through the ion sampling orifice 7 is preferably allowed to expand into the volume of a first vacuum chamber which preferably includes an exhaust port to exhaust the gas. Ions preferably then pass from the first vacuum chamber into a mass analyser for mass analysis. The entire process of generating analyte ions described above preferably occurs at or close to atmospheric pressure.

Figure 4:
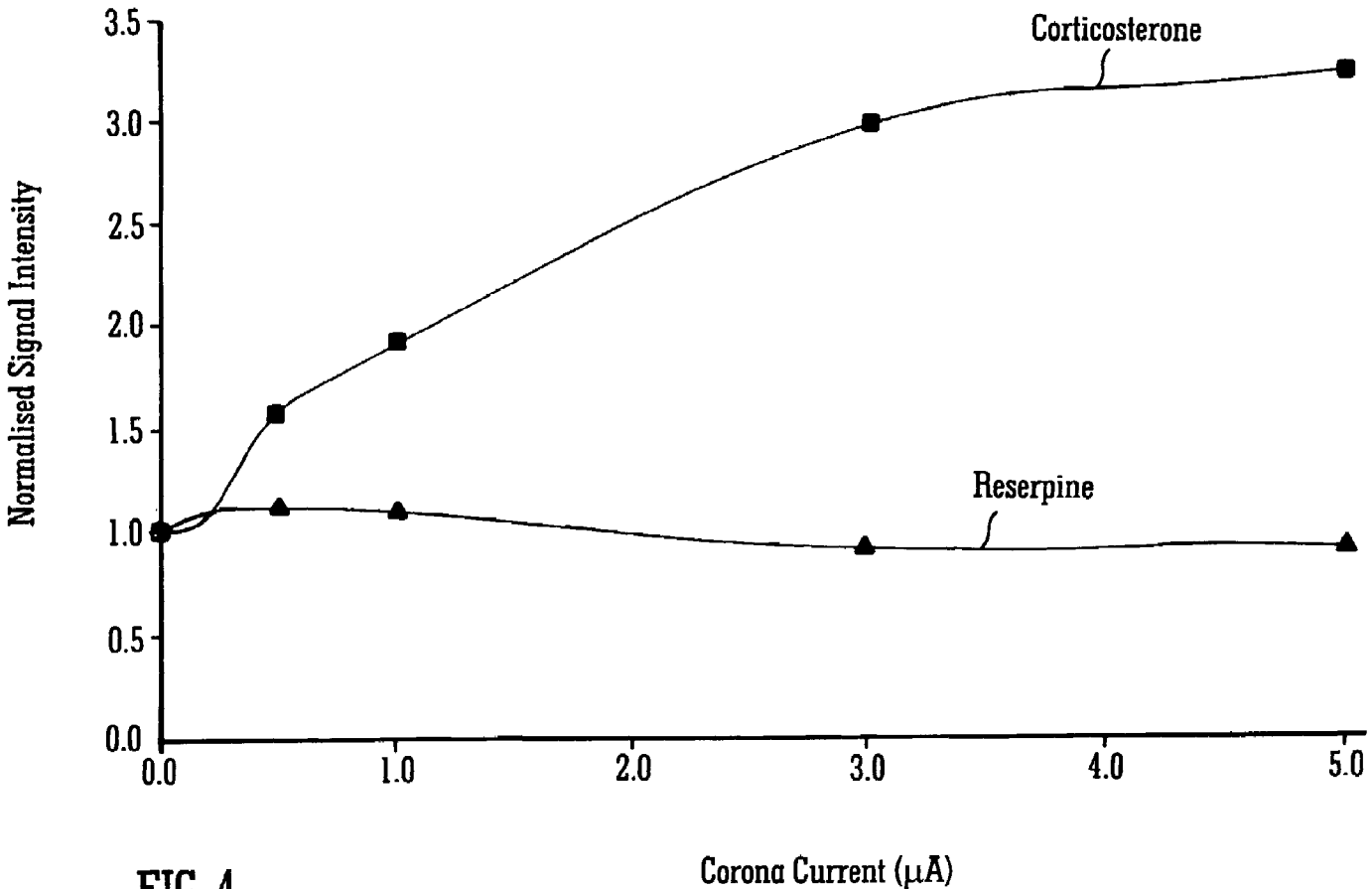
FIG. 4 illustrates how the ion signal intensity for a highly polar sample (Reserpine) and a low to moderately polar sample (Corticosterone) vary as an function of the current applied to a corona needle of an ion source according to an embodiment of the present invention.

FIG. 4 shows how the ion signal intensity varies with the current applied to the corona needle 5 of a preferred dual chamber ion source for the moderately polar analyte Corticosterone and for the relatively highly polar or ionic analyte Reserpine. It can be seen that the ion signal intensity observed for Corticosterone using the preferred ion source increases at a relatively high rate and then saturates at a relatively constant ion signal intensity as the current applied to the corona needle is increased. The variation of the ion signal intensity with current applied to the corona needle 5 for Corticosterone has some similarities to the response obtained using a conventional ion source as shown in FIG. 1. With regards Reserpine, it can be seen that as the current applied to the corona needle of the preferred ion source is increased, the ion signal intensity for Reserpine remains substantially constant (within experimental error) and certainly shows no significant fall off as the corona current is increased. This improved response is in direct contrast to the response obtained using a conventional ion source as shown in FIG. 1. The ion signal intensity for Reserpine does not show an increase with an increase in current applied to the corona needle due to the fact that Reserpine is already seemingly highly ionised by the time that it enters the reaction chamber 2. Increasing the current applied to the corona needle to increase the number of reagent ions produced does not therefore generate a significantly higher number of analyte ions in the case of a highly polar analyte.

The ion signal intensity obtained for Reserpine using the preferred ion source shows that the detrimental effects observed with conventional APCI ion sources when attempting to ionize highly polar or ionic analytes caused by the electric field generated by the corona needle are substantially eliminated when using an ion source according to the preferred embodiment of the present invention. Accordingly, the preferred ion source does not suffer from the problem of analyte ions being defocused or dispersed due to the effects of the corona discharge process.

According to the preferred embodiment the gaseous sample comprising the analytes passes through into the reaction chamber 2 without being significantly influenced by the electric field generated by the relatively high potential which is preferably applied to the corona needle 5 located in the adjacent corona chamber 1. The relatively highly polar analytes which typically enter the reaction chamber 2 as ions are therefore preferably not significantly retarded or dispersed in the ion source due to the electric field generated by the corona needle 5. As ions from relatively highly polar analytes are not dispersed in the preferred ion source they are able to be transmitted to the ion sampling orifice 7 preferably arranged downstream of the reaction chamber 2 for subsequent mass analysis with an increased efficiency. The ion signal intensity for relatively highly polar analytes is therefore increased compared with the ion signal intensity obtained when using a conventional ion source. This is particularly advantageous since it follows that relatively high ion signal intensities can be obtained for both highly polar or ionic analytes and also low to moderately polar analytes whilst supplying a constant current to the corona needle 5 (e.g. 5 μA). Therefore, a single experimental run can be conducted in which sufficiently high ion signal intensities can be obtained for all analytes in the sample irrespective of their polarity. Accordingly, the time required to analyse the sample and the volume of the sample required to conduct the analysis are significantly reduced compared with conventional APCI ion sources.

FIG. 5 shows an overlay of the ion signal intensities as a function of time for two separate Liquid Chromatography Mass Spectral ("LC/MS") MRM analyses of a sample comprising four different analytes using an ion source according to the preferred embodiment. The four different analytes and the four channel MRM experiment is essentially the same as described above in relation to FIG. 2. It can be seen from comparing FIGS. 2 and 5 that as with the ion signal intensities obtained when generating ions using a conventional ion source, when using the preferred ion source significantly different ion signal intensities are obtained for low to moderately polar analytes (e.g. Corticosterone and Hydroxyprogesterone) when relatively low and relatively high currents were applied to the corona needle (e.g. 0.2 μA and 5 μA respectively). The increase in ion signal intensity for low to moderately polar analytes in response to the increase in the current applied to the corona needle corresponds to an increase in the number of reagent ions generated in the corona chamber 1. Accordingly, there are an increased number of analyte molecule-reagent ion interactions in the reaction chamber 2 resulting in a higher number of analyte ions being produced which are then subsequently mass analysed.

In contrast to the ion signal intensities obtained using a conventional ion source, the ion signal intensities detected for the relatively highly polar analytes Verapamil and Reserpine using the preferred ion source varied relatively little when the current applied to the corona needle 5 was increased from 0.2 μA to 5 μA. Indeed there was hardly any discernible reduction in intensity for Resperine when the corona current was increased from 0.2 μA to 5 μA. Advantageously, when the current applied to the corona needle is maintained relatively high (i.e. 5 μA) the ion signal intensities detected for Verapamil and Reserpine are significantly higher when using the preferred ion source as compared to a conventional ion source.

It will be appreciated, therefore, that when the ion source according to the preferred embodiment is employed and a relatively high corona current (e.g. 5 μA) is applied to the corona needle a relatively high ion signal intensity can be obtained both for relatively highly polar and also for low to moderately polar analytes. This avoids the need to operate the corona needle of the ion source at different currents during two separate acquisitions. Accordingly, samples comprising analytes having both low to moderately polar analytes and also highly polar analytes can be analysed in a single experimental run wherein a moderate to high current (e.g. 3-10 μA) is applied to the corona needle 5. This single acquisition is advantageous in that both the total analysis time and the sample consumption volume are significantly reduced compared with conventional techniques.

The preferred Atmospheric Pressure Ionization ion source is further advantageous over conventional ion sources in that the sample gas flow is arranged such that analytes, involatiles and other contaminants in the sample gas do not flow past the corona needle 5. Material present in the sample gas flow is therefore not deposited on the tip of the corona needle 5 and hence the operation of the corona needle 5 is not degraded during use. The preferred ion source therefore also has a significantly improved long-term stability compared with conventional arrangements. The preferred ion source also reduces the carry-over of tuning compounds and enables reagent ions to be formed which are independent of the mobile phase, provided that the reaction thermodynamics are permitted.

FIG. 6 shows an ion source according to another preferred embodiment. This embodiment is substantially similar to the embodiment shown and described in relation to FIG. 3 except that the nebuliser probe 13 comprises a pneumatically assisted electrospray nebuliser 10 and a heated tube 3. According to this embodiment, the heated tube 3 is preferably grounded and the electrospray nebuliser 10 is preferably maintained at a relatively high voltage (e.g. 3 kV) with respect to the heated tube 3. Advantageously, the pneumatically assisted electrospray nebuliser probe ionises relatively highly polar analytes present in the sample with an increased efficiency compared with the pneumatic nebuliser 12 as shown in FIG. 3. Preferably substantially all relatively highly polar analytes are likely to be ionised by the pneumatically assisted electrospray nebuliser 13 before they pass into and through the reaction chamber 2.

Low to moderately polar analytes, which may not be efficiently ionised by the pneumatically assisted electrospray nebuliser 13 are preferably converted from the liquid to gas phase by the electrospray nebuliser 10 in combination with the heated tube 3. The low to moderately polar analytes then exit the heated tube 3 and are ionised in the reaction chamber 2 by molecule-ion reactions with reagent ions generated in the corona chamber 1 and passed into the reaction chamber 2. This embodiment forms the basis of an Electrospray Ionisation/Atmospheric Pressure Chemical Ionisation ("ESI/APCI") ion source that can ionise a wide range of compound classes and is particularly suited for use over a wide range of Liquid Chromatograph ("LC") flow rates with a high efficiency.

Although the present invention has been described with reference to preferred embodiments, it will be understood by those skilled in the art that various changes in form and detail may be made without departing from the scope of the invention as set forth in the accompanying claims.

The invention claimed is

1. An ion source for a mass spectrometer comprising: a discharge region with a discharge device arranged in said discharge region; and a substantially field free reaction region separate from the discharge region and connected to the discharge region by a passageway; wherein in use reagent ions created in said discharge region pass from said discharge region into said reaction region via said passageway and analyte molecules and/or analyte ions pass into said reaction region.

2. An ion source as claimed in claim 1, wherein said discharge region comprises a discharge chamber.

3. An ion source as claimed in claim 1, wherein said discharge device comprises a corona discharge device.

4. An ion source as claimed in claim 3, wherein said corona discharge device comprises a corona needle or pin.

5. An ion source as claimed in claim 1, wherein in a mode of operation a current is applied to said discharge device selected from the group consisting of: (i) <0.1 μA; (ii) 0.1-0.2 μA; (iii) 0.2-0.3 μA; (iv) 0.3-0.4 μA; (v) 0.4-0.5 μA; (vi) 0.5-0.6 μA; (vii) 0.6-0.7 μA; (viii) 0.7-0.8 μA; (ix) 0.8-0.9 μA; (x) 0.9-1.0 μA; and (xi)>1 μA.

6. An ion source as claimed in claim 1, wherein in a mode of operation a voltage is applied to said discharge device selected from the group consisting of: (i) <1 kV; (ii) 1-2 kV; (iii) 2-3 kV; (iv) 3-4 kV; (v) 4-5 kV; (vi) 5-6 kV; (vii) 6-7 kV; (viii) 7-8 kV; (ix) 8-9 kV; (x) 9-10 kV; and (xi)>10 kV.

7. An ion source as claimed in claim 1, wherein said reaction region comprises a reaction chamber.

8. An ion source as claimed in claim 1, further comprising a passage or orifice connecting or communicating said discharge region to or with said reaction region, wherein in use reagent ions created in said discharge region pass from said discharge region to said reaction region via said passage or orifice.

9. An ion source as claimed in claim 8, further comprising a housing enclosing said discharge region, said reaction region and said passage or orifice.

10. An ion source as claimed in claim 1, further comprising a gas inlet arranged upstream of said discharge region, said gas inlet receiving, in use, a reagent gas which is supplied to said discharge region.

11. An ion source as claimed in claim 1, further comprising a gas outlet arranged downstream of said reaction region, said gas outlet discharging, in use, gas and/or analyte ions.

12. An ion source as claimed in claim 1, wherein said ion source comprises an Atmospheric Pressure Ionisation ion source.

13. An ion source as claimed in claim 12, wherein said ion source comprises an Atmospheric Pressure Chemical Ionisation source.

14. An ion source as claimed in claim 1, wherein said discharge region and/or said reaction region are maintained, in use, at a pressure selected from the group consisting of: (i) <100 mbar; (ii) 100-500 mbar; (iii) 500-600 mbar; (iv) 600-700 mbar; (v) 700-800 mbar; (vi) 800-900 mbar; (vii) 900-1000 mbar; (viii) 1000-1100 mbar; (ix) 1100-1200 mbar; (x) 1200-1300 mbar; (xi) 1300-1400 bar; (xii) 1400-1500 mbar; (xiii) 1500-2000 mbar; and (xiv) >2000 mbar.

15. An ion source as claimed in claim 1, further comprising a spray device for spraying a sample and for causing said sample to form droplets.

16. An ion source as claimed in claim 15, further comprising means for supplying a nebulising gas to further nebulise said droplets formed by said spray device.

17. An ion source as claimed in claim 15, further comprising a heated surface or tube upon which, in use, at least some of said droplets formed by said spray device impinge.

18. An ion source as claimed in claim 17, wherein said heated tube discharges or supplies, in use, analyte molecules and/or analyte ions into said reaction region.

19. An ion source as claimed in claim 1, further comprising a pneumatic nebuliser.

20. An ion source as claimed in claim 1, further comprising a pneumatically assisted electrospray nebuliser.

21. A mass spectrometer comprising an ion source as claimed in claim 1.

22. A mass spectrometer as claimed in claim 21, wherein said mass spectrometer further comprises an ion sampling orifice.

23. A mass spectrometer as claimed in claim 22, further comprising at least one electrode arranged opposite or adjacent to said ion sampling orifice so as to deflect, attract, direct or repel at least some ions towards said ion sampling orifice.

24. A mass spectrometer as claimed in claim 21, wherein said ion source is connected, in use, to a gas chromatograph.

25. A mass spectrometer as claimed in claim 21, wherein said ion source is connected, in use, to a liquid chromatograph.

26. A mass spectrometer as claimed in claim 21, further comprising a mass analyser selected from the group consisting of: (i) a Time of Flight mass analyser; (ii) a quadrupole mass analyser; (iii) a Penning mass analyser; (iv) a Fourier Transform Ion Cyclotron Resonance ("FTICR") mass analyser; (v) a 2D or linear quadrupole ion trap; (vi) a Paul or 3D quadrupole ion trap; and (vii) a magnetic sector mass analyser.

27. An Electrospray IonisationIonisation/Atmospheric Pressure Chemical Ionisation ("ES IIAPCI") ion source comprising:

a corona discharge device arranged in a corona discharge chamber; a substantially field free reaction chamber arranged to receive reagent ions from said discharge chamber;

an electrospray probe arranged to receive analyte molecules and to direct a spray output into said reaction chamber;

wherein, in use, analyte molecules having a relatively low polarity are ionised by gas phase ion-molecule reactions with said reagent ions in said reaction chamber; and wherein, in use, analyte molecules having a relatively high polarity are ionised by electrospray ionisation to form analyte ions, said analyte ions ionised by electrospary ionisation or ionised by gas phase reations bypass, in use, said corona discharge chamber upon passing through said reaction chamber.

28. A method of producing ions comprising: providing a discharge region with a discharge device arranged in said discharge region, and a substantially field free reaction region separate from the discharge region and connected to the discharge region by a passageway; creating reagent ions in said discharge region and passing said reagent ions from said discharge region into said substantially field free reaction region via said passageway; and passing analyte molecules and/or analyte ions into said substantially field free reaction region.

29. The ion source of claim 11, wherein the gas outlet is associated with an outlet passage arranged off-axis with respect to an axis of an ion sampling orifice.

30. The ion source of claim 11, wherein the gas outlet is associated with an outlet passage having a flow axis that is non-colinear with a flow axis of the reaction region.

31. A method for producing ions for mass-spectrometry analysis, the method comprising:

providing a sample of analyte molecules comprising molecules that are relatively less polar and molecules that are relatively more polar;

directing an electrospray nebuliser output flow into a substantially field free reaction chamber, the electrospary nebuliser ionising a greater portion of the relatively more polar molecules than of the relatively less polar molecules;

creating reagent ions in a discharge chamber;

directing the reagent ions from the discharge chamber, via a passageway, into the substantially field free reaction chamber to ionize at least some of the relatively less polar analyte molecules; and directing analyte ions, associated with both the relatively less polar and relatively more polar molecules, from the substantially field free reaction region to an ion sampling inlet under the influence of both a flow of gas through the nebulizer and a flow of gas through the discharge chamber.

* * * * *